US006745909B1

(12) United States Patent
Lai

(10) Patent No.: US 6,745,909 B1
(45) Date of Patent: Jun. 8, 2004

(54) EXPANDABLE UPRIGHT TUBES OF A COAT RACK

(76) Inventor: Hsiu-Chen Lai, No. 1, Lane 150, Chang-Lu Rd., Chang Hua City (TW)

( * ) Notice: Subject to any disclaimer, the term of this patent is extended or adjusted under 35 U.S.C. 154(b) by 0 days.

(21) Appl. No.: 10/340,821

(22) Filed: Jan. 13, 2003

(51) Int. Cl.[7] ..... A47B 47/00

(52) U.S. Cl. ..... 211/206; 211/207; 211/204; 403/371; 403/296; 248/161

(58) Field of Search ..... 211/206, 204, 211/189, 175, 183, 207, 208, 123, 105.1, 196; 248/161, 406.1, 411, 410, 165, 188.5, 413, 412, 414, 159; 403/367, 368, 370, 371, 296, 297, 374.3, 374.4, 314, 409.1

(56) References Cited

U.S. PATENT DOCUMENTS

| | | | | | |
|---|---|---|---|---|---|
| 3,561,798 | A | * | 2/1971 | Redfern | 403/369 |
| 4,113,222 | A | * | 9/1978 | Frinzel | 248/412 |
| 4,152,086 | A | * | 5/1979 | Achenbach et al. | 403/334 |
| 5,154,449 | A | * | 10/1992 | Suei-Long | 285/298 |
| 5,474,403 | A | * | 12/1995 | Hetrich | 403/369 |
| 5,617,962 | A | * | 4/1997 | Chen | 211/206 |
| 5,649,780 | A | * | 7/1997 | Schall | 403/109.4 |
| 5,692,865 | A | * | 12/1997 | Pratt | 411/55 |
| 5,695,297 | A | * | 12/1997 | Geib | 403/371 |
| 5,810,504 | A | * | 9/1998 | Rabinovich | 403/371 |
| 6,027,087 | A | * | 2/2000 | Lindemann et al. | 248/188.5 |
| 6,095,713 | A | * | 8/2000 | Doyle et al. | 403/97 |
| 6,361,243 | B1 | * | 3/2002 | Geib | 403/369 |
| 6,401,948 | B1 | * | 6/2002 | Huang | 211/206 |
| 6,516,821 | B1 | * | 2/2003 | Uemura | 135/75 |
| 6,523,707 | B2 | * | 2/2003 | Liu | 211/206 |

FOREIGN PATENT DOCUMENTS

| | | | | |
|---|---|---|---|---|
| GB | 2020176 | A | * 12/1978 | 211/206 |

* cited by examiner

*Primary Examiner*—Jennifer E. Novosad
(74) *Attorney, Agent, or Firm*—Charles E. Baxley

(57) ABSTRACT

A coat rack includes two expandable upright tubes, each upright tube being formed of an inner tube, an outer tube, and an expandable and contractable tightening ring. The inner tube is rotatably fastened at the top end to a top cross bar and is provided at the bottom end with a tapered outer threaded portion which is engaged with an inner threaded portion of the tightening ring. The bottom end of the inner tube is slidably disposed in the top end of the outer tube such that the inner tube is securely located in the outer tube by a clockwise rotation of the inner tube, and such that the inner tube becomes slidable in the outer tube by a counterclockwise rotation of the inner tube.

2 Claims, 4 Drawing Sheets

EXPANDABLE UPRIGHT TUBES OF A COAT RACK

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a coat rack, and particularly to two expandable upright tubes of the coat rack.

BACKGROUND OF THE INVENTION

The conventional coat rack comprises two expandable upright tubes which are formed of an inner tube and an outer tube. The inner tube is fastened at the top end to a top cross bar for hanging the coats, and at the bottom end to the top end of the outer tube which is in turn fastened at the bottom end to a base frame. The bottom end of the inner tube is slidably fitted into the top end of the outer tube in conjunction with a locating knob and a threaded rod, which are incapable of holding the inner tube and the outer tube together securely. In another words, the top cross bar is apt to sway.

BRIEF SUMMARY OF THE INVENTION

The primary objective of the present invention is to provide a coat rack with two expandable upright tubes which are securely mounted on a base frame of the coat rack.

In keeping with the principle of the present invention, the foregoing objective of the present invention is attained by a coat rack comprising a base frame, two expandable upright tubes, and a top cross bar. The two expandable upright tubes are mounted on the base frame and are formed of an inner tube, an outer tube, and a tightening ring. The top cross bar is provided at two longitudinal ends with a fastening tube for fastening rotatably the top end of the inner tube.

The bottom end of the inner tube is provided with a tapered outer threaded portion and a stop portion. The outer tube is fastened at the bottom end with the base frame and is detachably fastened at the top end with the bottom end of the inner tube in conjunction with the tightening ring which is provided with an inner threaded portion and is fitted into the outer tube along with the bottom end of the inner tube. The outer threaded portion of the inner tube is engaged with the inner threaded portion of the tightening ring. As the inner tube is turned clockwise, the tightening ring is forced to expand radially to press against the inner wall of the outer tube. As a result, the inner tube and the outer tube are securely fastened end to end. As the inner tube is turned counterclockwise, the tightening ring moves away from the inner wall of the outer tube, thereby enabling the inner tube to slide in the outer tube.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
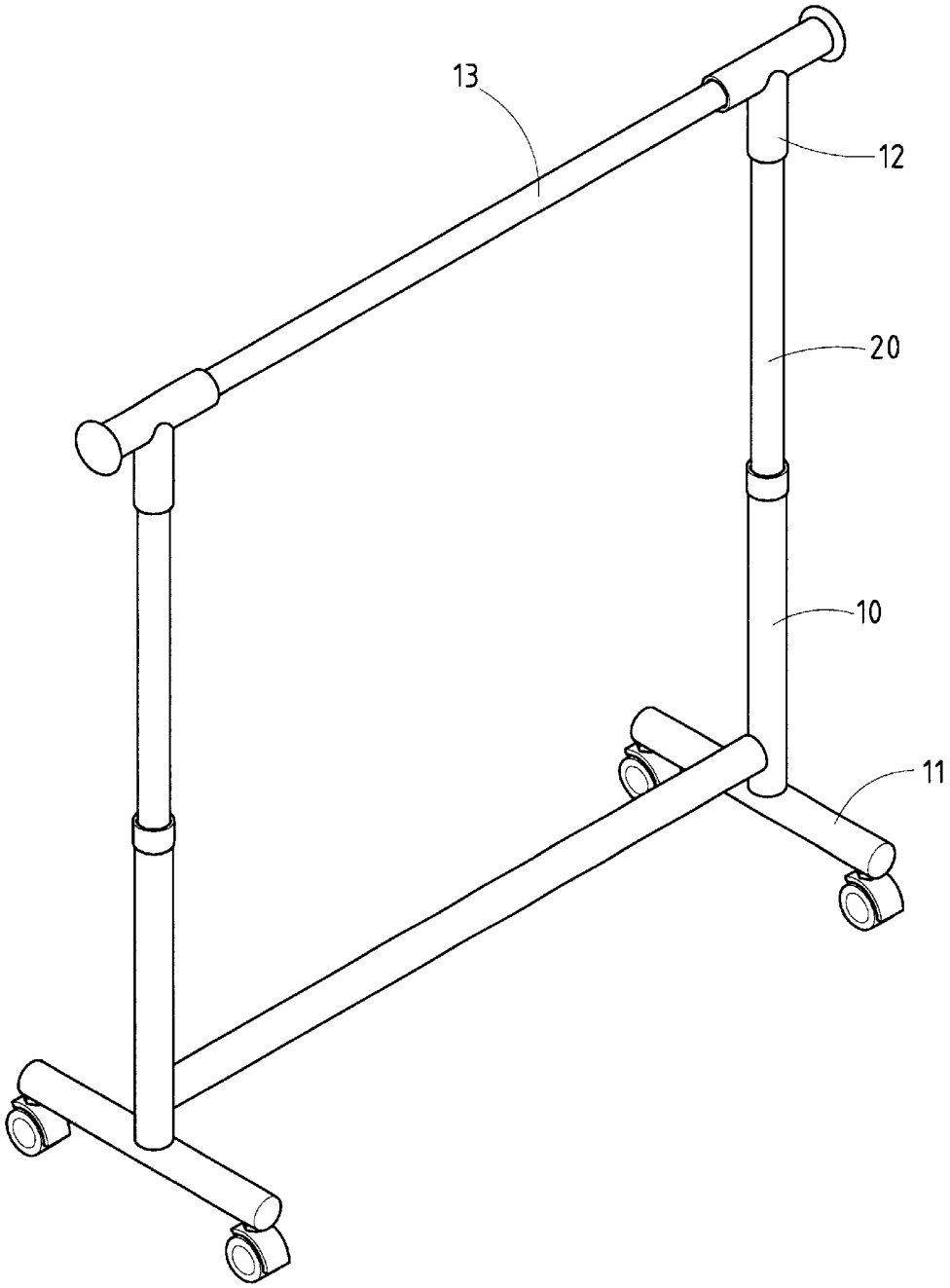
FIG. 1 shows a perspective view of the preferred embodiment of the present invention.

As shown in FIGS. 1–4. a coat rack embodied in the present invention comprises a base frame 11, a top cross bar 13 for hanging coats, and two expandable upright tubes, each being formed of an outer tube 10, and an inner tube 20. The top cross bar 13 is provided at two longitudinal ends with a fastening tube 12, which is perpendicular to the top cross bar 13.

Figure 2:
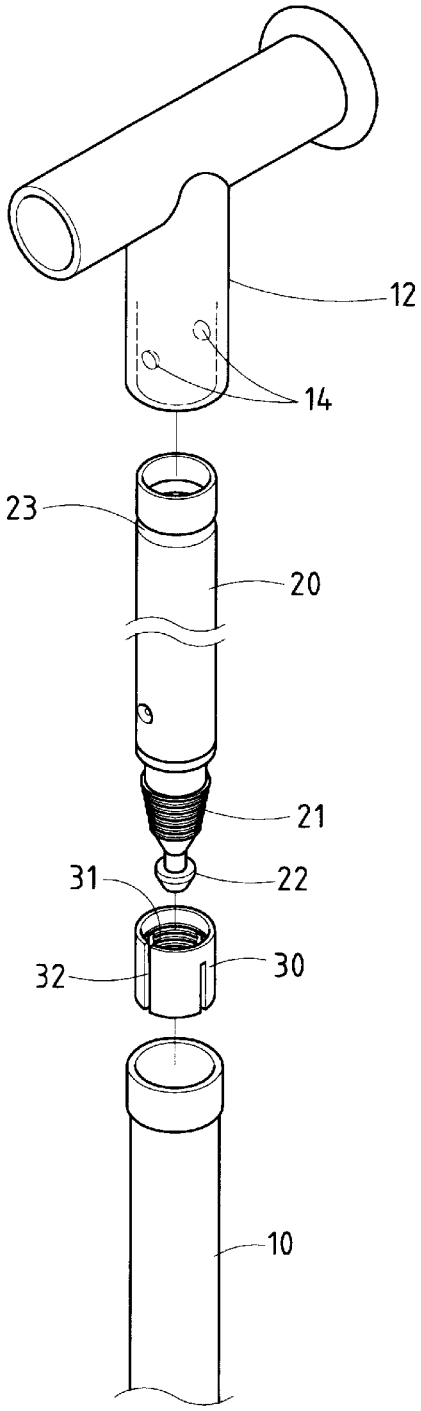
FIG. 2 shows an exploded perspective view of the expandable upright tube of the present invention.
Figure 3:
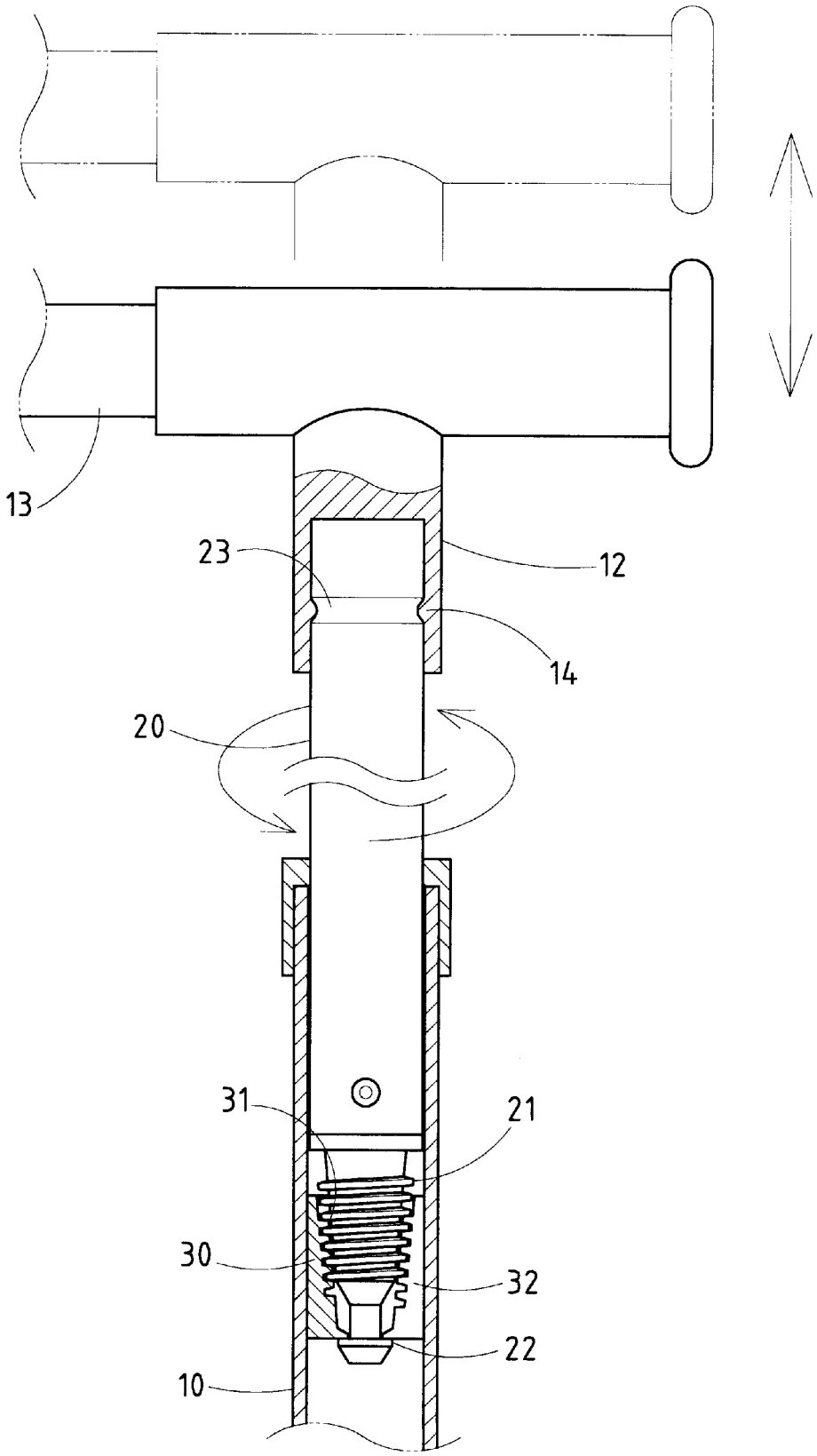
FIG. 3 shows a longitudinal sectional view of the expandable upright tube of the present invention.
Figure 4:
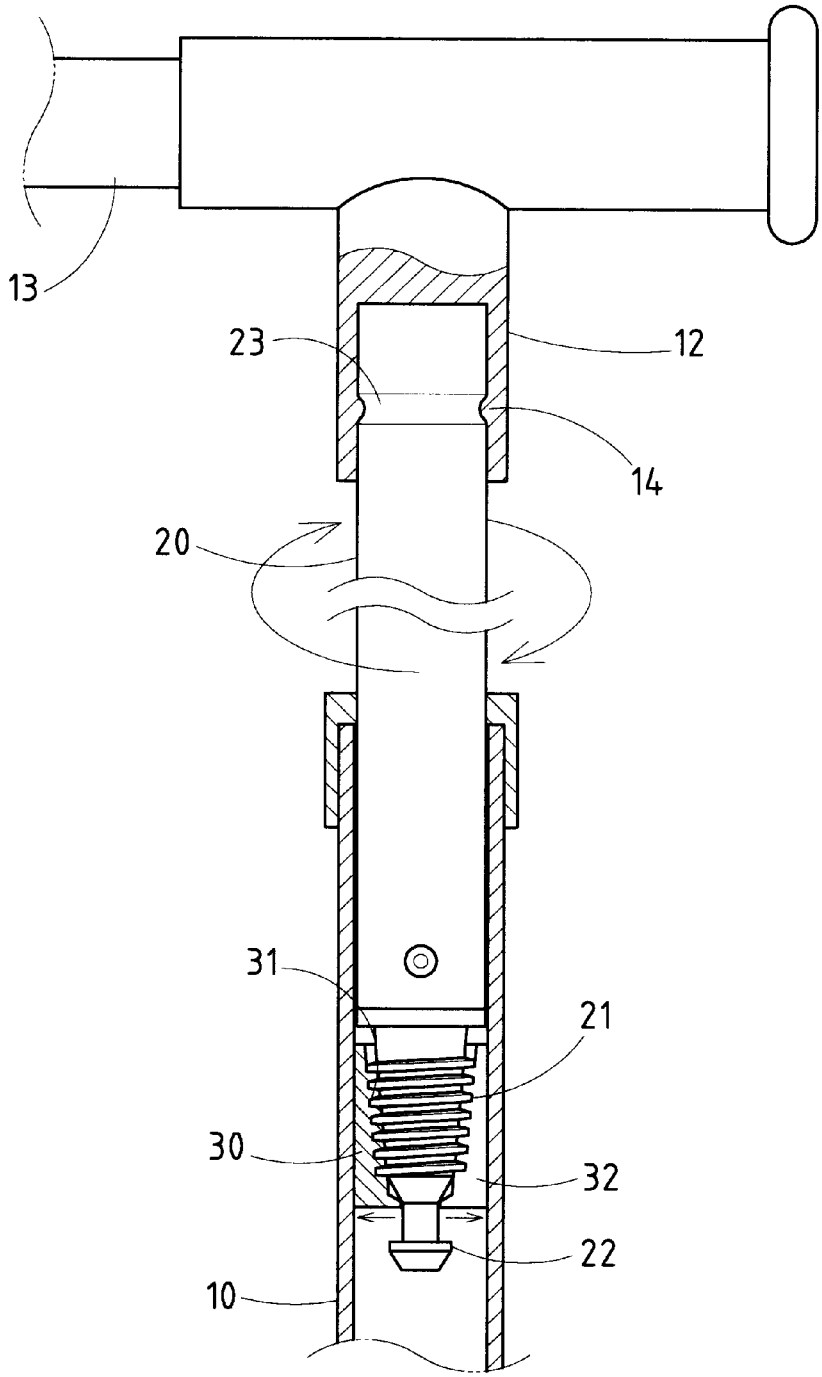
FIG. 4 shows another longitudinal sectional view of the expandable upright tube of the present invention.

As shown in FIGS. 2, 3, and 4, the top end of the inner tube 20 is fastened rotatably with the free end of the fastening tube 12. The inner tube 20 is provided at the bottom end with an outer threaded portion 21 of a tapered construction, and a stop portion 22 extending from the free end of the outer threaded portion 21.

A tightening ring 30 is provided with an inner threaded portion 31 and one or more slits 32 enabling the tightening ring 30 to expand or contract radially. The tightening ring 30 is fitted over the bottom end of the inner tube 20 such that the inner threaded portion 31 of the tightening ring 30 is engaged with the outer threaded portion 21 of the inner tube 20.

The bottom end of the inner tube 20 is slidably received in the top end of the outer tube 10 along with the tightening ring 30. As the inner tube 20 is turned clockwise, as shown in FIG. 4, the tightening ring 30 is forced by the bottom end of the inner tube 20 to expand radially to press against the inner wall of the outer tube 10, so as to locate securely the bottom end of the inner tube 20 inside the outer tube 10.

As illustrated in FIG. 3, when the inner tube 20 is turned counterclockwise, the outer threaded portion 21 of the inner tube becomes partially disengaged with the inner threaded portion 31 of the tightening ring 30, thereby resulting a radial contraction of the tightening ring 30. As a result of the contraction of the tightening ring 30, the inner tube 20 can be slid up and down in the outer tube 10. In light of the bottom end of the inner tube 20 moving away from the tightening ring 30 amid the counterclockwise rotation of the inner tube 20, the stop portion 22 of the bottom end of the inner tube 20 serves to prevent the separation of the bottom end of the inner tube 20 from the tightening ring 30.

The top end of the inner tube 20 is optionally provided in the outer wall with an annular groove 23, while the inner wall of the free end of the fastening tube 12 is provided with an annular projection 14. The top end of the inner tube 20 is rotatably fastened with the free end of the fastening tube 12 in such a way that the annular projection 14 is received in the annular groove 23 of the inner tube 20, as shown in FIGS. 3 and 4.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A coat rack comprising:

a base frame;

two expandable upright tubes, each upright tube being fastened at an end to said base frame; and a top cross bar provided at two longitudinal ends with a fastening tube for rotatably fastening to a top end of said expandable upright tubes;

wherein said two expandable upright tubes are comprised of an inner tube, an outer tube, and a tightening ring, said outer tube being fastened at a bottom end to said base frame, said inner tube being fastened rotatably at a top end to one of said two fastening tubes of said top cross bar, said inner tube being comprised of, at a bottom end, a tapered outer threaded portion and a stop portion extending from one end of said outer threaded portion, said tightening ring being comprised of an inner threaded portion and one or more allowance slits, said tightening ring being fitted over the bottom end of said inner tube in such a manner that said inner threaded portion of said tightening ring is engaged with said tapered outer threaded portion of the bottom end of said inner tube, and such that said tightening ring is prevented from being separated from the bottom end of said inner tube by said stop portion of the bottom end of said inner tube whereby the bottom end of said inner tube is slidably received in a top end of said outer tube along with said tightening ring such that the bottom end of said inner tube is securely located in the top end of said outer tube as a result of a clockwise rotation of said inner tube, and such that the bottom end of said inner tube becomes slidable in the top end of said outer tube as a result of a counterclockwise rotation of said inner tube.

2. The coat rack as defined in claim 1, wherein the top end of said inner tube is comprised of, in an outer wall, an annular groove; wherein the fastening tube of said top cross bar is comprised of, in an inner wall, an annular projection whereby said fastening tube is rotatably fastened to the top end of said inner tube such that said annular projection of said fastening tube is retained in said annular groove of the top end of said inner tube.

* * * * *